US009150977B2

(12) United States Patent
Kim et al.

(10) Patent No.: US 9,150,977 B2
(45) Date of Patent: Oct. 6, 2015

(54) COPPER PLATING SOLUTION

(71) Applicant: HOJIN PLATECH CO., LTD., Ansan-Si (KR)

(72) Inventors: Pan Soo Kim, Yongin-Si (KR); Duk Haeng Lee, Bucheon-Si (KR); Woon Suk Jung, Ansan-Si (KR)

(73) Assignee: HOJIN PLATECH CO., LTD., Ansan-Si (KR)

( * ) Notice: Subject to any disclaimer, the term of this patent is extended or adjusted under 35 U.S.C. 154(b) by 0 days.

(21) Appl. No.: 14/174,754

(22) Filed: Feb. 6, 2014

(65) Prior Publication Data

US 2014/0151238 A1 Jun. 5, 2014

Related U.S. Application Data

(63) Continuation of application No. PCT/KR2013/001005, filed on Feb. 7, 2013.

(30) Foreign Application Priority Data

Feb. 8, 2012 (KR) ..... 10-2012-0012645

(51) Int. Cl.
*C25D 3/38* (2006.01)
*C23C 18/40* (2006.01)

(52) U.S. Cl.
CPC ..... *C25D 3/38* (2013.01)

(58) Field of Classification Search
CPC ..... C25D 3/38; C25D 7/00; C25D 7/126
USPC ..... 205/296; 106/1.26
See application file for complete search history.

(56) References Cited

U.S. PATENT DOCUMENTS

| | | | | |
|---|---|---|---|---|
| 4,657,632 | A * | 4/1987 | Holtzman et al. | 216/13 |
| 4,842,946 | A | 6/1989 | Foust et al. | |
| 5,604,185 | A * | 2/1997 | Hen | 507/119 |

FOREIGN PATENT DOCUMENTS

| | | | | |
|---|---|---|---|---|
| JP | 07-207490 | | 8/1995 | |
| JP | 2000-297387 | | 10/2000 | |
| KR | 10-2009-0098538 | | 9/2009 | |
| KR | 10-0936348 | | 1/2010 | |
| WO | WO 2010083319 | A2 * | 7/2010 | C07C 251/86 |

OTHER PUBLICATIONS

Sulfuric acid, http://www.princeton.edu/~achaney/tmve/wiki100k/docs/Sulfuric_acid.html, p. 1.*

* cited by examiner

*Primary Examiner* — Edna Wong
(74) *Attorney, Agent, or Firm* — Perkins Coie LLP

(57) ABSTRACT

The present invention relates to a copper plating solution for relieving the deposit stress of an electroplated copper film. In the copper electroplating solution of the present invention, glycerin propoxylate ethoxylate is used as a carrier for relieving the deposit stress, and phenylurea is added as a deposit stress relieving additive. The copper electroplating solution of the present invention includes the phenylurea by from about 0.02 to about 0.08 g/l.

1 Claim, 1 Drawing Sheet

COPPER PLATING SOLUTION

CROSS-REFERENCE TO RELATED APPLICATIONS

This application is a continuation of, under 35 U.S.C. §120, International Application No. PCT/KR2013/001005, filed on Feb. 7, 2013, which claims priority of Korean Patent Application No. 10-2012-0012645, filed on Feb. 8, 2012, the entire contents of which are hereby incorporated by reference.

TECHNICAL FIELD

The present invention disclosed herein relates to a copper plating solution, and more particularly, to a copper electroplating solution relieving the deposit stress of an electroplated copper film.

BACKGROUND

A desired material to be plated is deposited on the surface of an object positioned at a negative electrode by using electroplating utilizing the principle of electrolysis. Basic elements for the electroplating include a positive electrode, a negative electrode and an electrolyte. In addition, the electrolyte includes a metal material or ions of the metal to be plated.

During the electroplating, deposit stress may be generated at a plated film. The deposit stress includes a compressive stress and a tensile stress. These stresses induce various limitations. These limitations include the adhesion of an electroplated film and a base material, the breaking phenomenon due to the deformation of the base material, the difficulty of assembling during conducting an assembling process of a plated base material, the deterioration of the reliability of a product, the decrease of the lifetime of a product and the like. Particularly, the limitations due to the deposit stress may be generated more significantly in a product in which the plating is conducted only on one side thereof when compared to a product plated on both sides thereof.

For example, when manufacturing an electrode for a touch screen of which use is increasing due to the explosive increase of smart devices in these days, if employing an electroplating method instead of a screen printing method or a sputtering method, only one side is usually plated. In addition, when manufacturing an electrode used in a solar cell which is one of clean energy sources by the electroplating method instead of the common screen printing method, only one side is usually plated. The one-side plating causes the base material of a product manufactured by the electroplating to be deformed, or the adhesive strength of the base material such as a silicon wafer, reinforced glass or a plastic resin with a plated film to be deteriorated due to the above-described deposit stress.

If the electrode of the solar cell or the electrode of the panel of the touch screen is manufactured by applying the electroplating method, the price competitiveness is improved as compared to other plating methods. However, despite the price competitiveness, since the electroplating method causes technical disadvantages as described above, the electroplating method has not been actually utilized.

Accordingly, if the deposit stress generated in the electroplated copper film could be relieved, a copper electroplating method could be applied, and thus, production costs may be largely reduced. Particularly, economic feasibility is even more significant when considering the steep increase of the production costs due to the price rise of a silver paste, etc. that are currently used as the electrode.

The present technology described in this patent document is a result of the research efforts by the inventors and can be used to address the above-described limitations.

SUMMARY

One implementation of the disclosed technology in this patent document is providing a novel plating solution for relieving deposit stress generated in an electroplated copper film.

Meanwhile, other benefits not specified in this patent document may be considered within a reasonable scope that may be easily obtained from the detailed description and the effects herein below.

The disclosed technology in this patent document provides a copper electroplating solution including phenylurea as a deposit stress relieving agent. In some embodiments, the amount of the phenylurea added may be from about 0.02 g/l to about 0.08 g/l.

The copper electroplating solution prepared by the disclosed technology in this patent document has very low deposit stress even under a condition at a high current density. In addition, when the electrode of a solar cell or a touch screen is formed by using the copper electroplating solution, a product such as the solar cell or the touch screen is not deformed. In addition, a remarkable effect of improving the adhesive strength between a base material and an electroplated copper film may be accomplished.

The reliability of a product and the lifetime of the product increase at the same time. In addition, breakage defects generated due to the deformation of the product during a manufacturing process may be decreased. As described above, the deposit stress generated during conducting copper electroplating may be decreased. Further, the disclosed technology in this patent document can be widely employed in various applications.

The potential effects expected by the technical features of this patent document but not specifically referred to in the specification would be regarded as the effects referred to in the specification.

Figure 1:
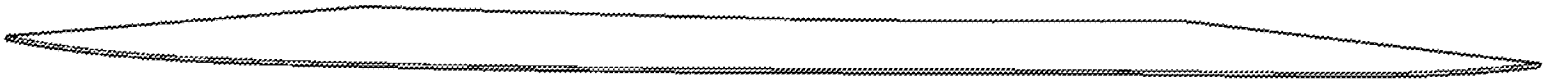
FIG. 1 illustrates a plated object with little deformation obtained when copper electroplating is performed with respect to a solar cell by using a solution including phenylurea according to an implementation of the disclosed technology in this patent document.
Figure 2:
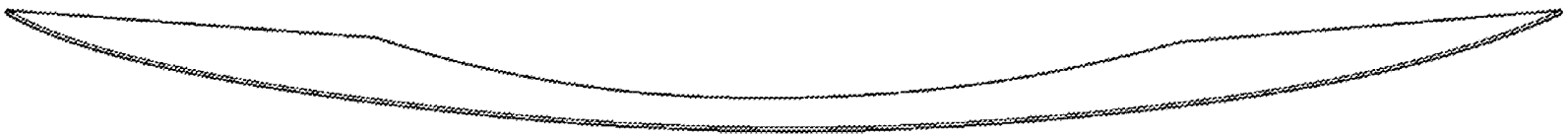
FIG. 2 (Prior Art)
FIG. 2 illustrates a plated object with deformation obtained when copper electroplating is performed with respect to a solar cell by using a solution excluding phenylurea according to the conventional method (Comparative Example 1).

The accompanying drawings are included to provide a further understanding of the inventive concept, and the scope of the right of the present invention is not limited thereto.

DETAILED DESCRIPTION

Hereinafter detailed description on related known functions will be omitted while explaining the present invention when the known functions are obvious to a person skilled in the art and are considered to unnecessarily obscure the gist of the present invention.

A plated film is obtained by performing a copper electroplating after adding phenylurea. By measuring the deposit stress of the plated film, it is confirmed that the deposit stress with respect to the plated copper film is relieved by the phenylurea.

That is, a stress relieving agent for removing the deposit stress is added during the copper electroplating. The stress relieving agent may include a phenylurea. A basic bath added includes ions of a metal and an electrolyte such as a copper sulfate, a sulfuric acid and chloride ions. In addition, as the carrier of a copper plating bath, one or two components among glycerin propoxylate ethoxylate derivatives may be included.

The amount of the carrier, glycerin propoxylate ethoxylate, as the additive is preferably from about 0.05 to about 2.0 g/l. The most appropriate concentration is about 1.0 g/l in some implementations. In addition, the phenylurea is added as a deposit stress relieving agent from about 0.02 to about 0.08 g/l, and the most preferable concentration is about 0.06 g/l in some implementations.

The preferred working current density is from about 1.0 $A/dm^2$ to about 5.0 $A/dm^2$.

EXAMPLE 1

First, the conditions of copper electroplating are explained as follows. A phosphor-containing copper electrode is used as a positive electrode. At a negative electrode, a specimen for measuring deposit stress is installed. A copper electroplating solution includes an acidic solution including 120 g/l of copper sulfate, 160 g/l of sulfuric acid, and 70 mg/l of chloride ions as a base. A carrier includes 1.0 g/l of GEP 2800, glycerin propoxylate ethoxylate derivative. In addition, 0.02 g/l of phenylurea (PU) is added into the plating solution.

Then, a specimen at the negative electrode having the plating area of 7.6 $cm^2$ is plated by using the plating solution with the working current density of 4.5 $A/dm^2$ at the working temperature of 28° C. for 40 minutes. As the result, a plated film having the thickness of about 40 μm is obtained.

EXAMPLE 2

The phenylurea of 0.04 g/l is added to the plating solution. The remaining conditions are the same as those in Example 1.

EXAMPLE 3

The phenylurea of 0.06 g/l is added to the plating solution. The remaining conditions are the same as those in Example 1.

EXAMPLE 4

The phenylurea of 0.08 g/l is added to the plating solution. The remaining conditions are the same as those in Example 1.

COMPARATIVE EXAMPLE 1

Different from the above examples, a conventional plating solution is used. That is, a phosphor-containing copper electrode is used as a positive electrode. At a negative electrode, a specimen for measuring deposit stress is installed. A copper electroplating solution includes an acidic solution including 120 g/l of copper sulfate, 160 g/l of sulfuric acid, and 70 mg/l of chloride ions as a base, and a carrier which includes 1.0 g/l of GEP 2800 (glycerin propoxylate ethoxylate) . In addition, 0.04 g/l of 3-mercapto-1-proganesulfonic acid, sodium salt (MPS) is added into the plating solution. Then, the specimen at the negative electrode having the plating area of 7.6 $cm^2$ is plated by using the plating solution with the working current density of 4.5 $A/dm^2$ at the working temperature of 28° C. for 40 minutes. As the result, a plating film having the thickness of about 40 μm is obtained.

COMPARATIVE EXAMPLE 2

The leveling agent, PVP of 0.5 mg/l is added. The remaining conditions are the same as those in Comparative Example 1.

EXPERIMENTAL EXAMPLE

Deposit stress for each of the specimens of Examples 1 to 4 and Comparative Examples 1 and 2 is measured. For the comparison of the deposit stress, the specimens according to Examples 1 to 4 according to the disclosed technology in this patent document and Comparative Example 1 using a conventional copper electroplating solution are compared, and the change of the deposit stress according to the concentration of the deposit stress relieving agent and the change of the deposit stress according to time after the copper electroplating are measured. A deposit stress measuring method of a test strip is used as a measuring method, 683 EC Deposit Stress Analyzer is used as a measuring equipment, and a Be-Cu alloy product is used as a measuring specimen. The measured results of the deposit stress according to the examples and the comparative examples are illustrated in the following Table 1. In Table 1, the deposit stress of an initial electroplated copper film immediately after conducting the plating, and the change of the deposit stress after standing for a certain time at room temperature are illustrated.

TABLE 1

| Component of copper electroplating solution | | Change of deposit stress with standing time (MPa) | | | | |
|---|---|---|---|---|---|---|
| | | 0 hr | 24 hr | 48 hr | 72 hr | 96 hr |
| Example 1 | PU 0.02 g/l | 1.5041 | 1.7547 | 2.2562 | 2.3815 | 2.5068 |
| Example 2 | PU 0.04 g/l | 1.2187 | 1.4625 | 2.3156 | 2.3156 | 2.1937 |
| Example 3 | PU 0.06 g/l | 0.9972 | 1.2465 | 2.2437 | 2.1191 | 2.2437 |
| Example 4 | PU 0.08 g/l | 0.8596 | 1.2280 | 1.9648 | 1.9648 | 2.4560 |
| Comparative Example 1 | MPS 0.04 g/l | 4.3683 | 7.0082 | 6.9767 | 6.9767 | 6.9139 |
| Comparative Example 2 | Comparative Example 1 + PVP 0.5 mg/l | 9.1899 | 8.2392 | 7.9344 | 7.7388 | 7.4470 |

When comparing the deposit stresses of the electroplated copper films according to Examples 1 to 4 and Comparative Examples 1 and 2, it would be found that the deposit stresses of Examples 1 to 4 are very low. In addition, when comparing the results of Comparative Example 1 and Comparative Example 2, it would be found that the deposit stress of Comparative Example 2 in which the leveling agent, PVP is added as the additive into the plating solution is even further higher. That is, the inclusion of an organic material of a leveling agent group does not relieve the deposit stress. Rather, the deposit stress is increased with the inclusion of the organic material of the leveling agent group.

Based on the experimental results, the actual plating is conducted with respect to a solar cell, and deformation degree is measured first to examine the effects according to the relief of the deposit stress with respect to an actual product. The basic conditions of the copper electroplating solution are set to the same conditions of Example 3 and Comparative Example 1, and the copper electroplating is conducted. FIG. 1 illustrates the deformation degree of a product after conducting the copper electroplating. The measurement of the deformation degree is performed by using a feeler gauge. The deformation degree of the solar cell plated according to Example 3 is less than or equal to about 0.15 mm, and the deformation degree of the solar cell plated according to Comparative Example 1 is about 1.2 mm.

Second, specimens are prepared as follows to examine the influence of the deposit stress of the electroplated copper film to the adhesive strength. On a glass substrate on which ITO was coated, chromium and copper are coated by a vacuum deposition as a seed layer for conducting electroplating. The specimen is plated by using the solution compositions of Example 3 or Comparative Example 1 with the working current density of 1.5 A/dm$^2$ at the working temperature of 28° C. for 5 minutes to form a plated copper film having the thickness of about 2.5 μm. Then, to test the adhesive strength of the electroplated copper film, cross-cutting is performed with the plated copper film at intervals of about 1 mm. Attaching and detaching are repeated for three times with respect to the plated film cross-cut by using a 3M #610 tape, and the adhesive strength is compared. As a result, it would be found that the adhesive strength is improved a lot for the case when adding the phenylurea according to Example 3.

From the experimental results, it would be found that the deposit stress is greatly reduced for the case in which the copper electroplating solution including the phenylurea is used, and thus, the deformation of the solar cell due to the electroplating is rarely generated, and the plating adhesive strength on a resin such as a touch panel is improved, when compared to the case in which the copper electroplating solution excluding the phenylurea is used.

In addition, the protection scope of the present invention is not limited to the description and the expression of explicitly explained examples above. Further, it will be understood that the protection scope of the present invention is not limited by obvious modifications or substitutions in the technical fields of the present invention.

The invention claimed is:

1. A copper electroplating solution comprising ions of a copper and a phenylurea as an additive for relieving deposit stress, wherein an amount of the phenylurea is from about 0.02 g/l to about 0.08 g/l, and the copper electroplating solution further comprises a glycerin propoxylate ethoxylate derivative.

* * * * *